United States Patent [19]

Davies, deceased et al.

[11] Patent Number: 5,018,226

[45] Date of Patent: May 28, 1991

[54] APPARATUS AND METHOD FOR TRANSPORTING AN INJURED PERSON

[75] Inventors: Eric Davies, deceased, late of Surrey, Canada, by William P. Williams, executor; Ian R. McAllister, Vancouver, Canada

[73] Assignee: William Price Williams, Surrey, Canada

[21] Appl. No.: 234,422

[22] Filed: Aug. 19, 1988

[51] Int. Cl.[5] ..... A61G 1/00

[52] U.S. Cl. ..... 5/82 R; 5/453; 5/455

[58] Field of Search ..... 5/81 R, 82 R, 455, 453; 128/89 R, D 15

[56] References Cited

U.S. PATENT DOCUMENTS

| | | | |
|---|---|---|---|
| 1,027,764 | 1/1912 | Rilleau . | |
| 2,770,465 | 11/1956 | Dandurand . | |
| 3,121,881 | 2/1964 | Schnell . | |
| 3,186,405 | 6/1965 | Bailey et al. . | |
| 3,212,497 | 10/1965 | Dickinson . | |
| 3,286,707 | 11/1966 | Shafer . | |
| 3,460,531 | 8/1969 | Gardner . | |
| 3,462,775 | 8/1969 | Markwitz et al. . | |
| 3,477,071 | 11/1969 | Emerson . | |
| 3,513,489 | 5/1970 | Miller et al. . | |
| 3,609,778 | 10/1973 | Zeiner . | |
| 3,740,777 | 6/1973 | Dee . | |
| 3,775,782 | 12/1973 | Rice et al. . | |
| 3,802,004 | 4/1974 | Whitney . | |
| 3,811,139 | 5/1974 | Shaw | 5/81 R X |
| 3,933,150 | 1/1976 | Kaplan et al. | 128/DIG. 15 X |
| 4,024,861 | 5/1977 | Vincent . | |
| 4,033,000 | 7/1977 | Bonifay | 5/82 R |
| 4,039,039 | 8/1977 | Gottfried . | |
| 4,067,075 | 1/1978 | Leathers et al. . | |
| 4,104,750 | 8/1978 | Kelter et al. . | |
| 4,157,713 | 6/1979 | Clarey . | |
| 4,182,320 | 1/1980 | Sweeney . | |
| 4,183,110 | 1/1980 | Kidd et al. | 5/82 R |
| 4,234,982 | 11/1980 | Bez et al. . | |
| 4,254,518 | 3/1981 | Buhren et al. . | |
| 4,301,791 | 11/1981 | Franco, III | 5/455 X |
| 4,331,133 | 5/1982 | Arkans . | |
| 4,340,042 | 7/1982 | Smith . | |
| 4,375,809 | 3/1983 | Meals . | |
| 4,393,867 | 7/1983 | Baron | 128/89 R X |
| 4,507,655 | 8/1986 | Wagner et al. . | |
| 4,528,704 | 7/1986 | Wegener et al. . | |
| 4,624,248 | 11/1986 | Poole et al. . | |

FOREIGN PATENT DOCUMENTS

| | | | |
|---|---|---|---|
| 2263605 | 12/1974 | Fed. Rep. of Germany . | |
| 268 | of 1892 | United Kingdom | 5/82 R |
| 1031814 | 6/1966 | United Kingdom | 5/82 R |
| 2041764 | 9/1979 | United Kingdom | 5/82 R |

*Primary Examiner*—Gary L. Smith
*Assistant Examiner*—Michael J. Milano
*Attorney, Agent, or Firm*—Hughes & Multer, PS

[57] ABSTRACT

A transport unit particularly adapted to contain an injured person in a manner that the person can be moved with relative comfort and safety. There is a rigid containing structure having inflatable cushions positioned therein and arranged to fit the contours of a person's body. The person is placed in the container, and a lid of the container is placed over the person, with the cushions then being inflated to firmly, yet gently, hold the person in place.

26 Claims, 4 Drawing Sheets

APPARATUS AND METHOD FOR TRANSPORTING AN INJURED PERSON

BACKGROUND OF THE INVENTION

1. Field of the Invention

The present invention relates to a carrying and support system for a person, and more particularly to such a system having a portable container to contain an injured person with relative comfort and safety in a manner that the person can be properly moved to another location. The system of the present invention is particularly adapted to permit a burn victim to be moved to a treatment location.

2. Background Art

There are difficulties in transporting an injured person in an emergency situation where it is necessary to move that person over rough or difficult terrain. Further, there are particular problems where the person is a burn victim who must be transported.

Several years ago Mr. Eric Davies (now deceased), one of the co-inventors herein, was in a driving accident where various surface areas of his body were burned, and it was necessary for him to be transported to a hospital. A common method of transporting such a victim (and the one which was used in Mr. Davies' situation) is to place the victim on a stretcher and then apply straps over the person to hold the person securely to the stretcher. The discomfort and pain in such a situation can be substantial, particularly where the retaining straps engage the burned portion from the person's body. Further, the retaining straps and other components of the stretcher system which engages a person's body can cause further damage if the localized force or pressure is excessive, or if there is rubbing or abrasion. Then if there is any jostling of the stretcher system while the person is retained thereon, this can further aggravate the pain and discomfort. It was as a result of this incident that Mr. Davies was motivated to find a transport system which could be used effectively in these circumstances. Mr. Davies was not able to find any system available which answered these needs, and this led Mr. Davies to initiate the project of devising such a system.

A search of the patent literature has disclosed a number of systems for transporting a person, and a number of these have utilized inflatable components. Some of these systems utilize inflatable components to provide structural members or a structural framework which actually functions as the supporting structure. One of the difficulties with such a system is that for the inflatable member to function adequately as a structural member, the component must be pressurized to the extent that it presents a somewhat unyielding surface, with diminishing ability to function as a yielding cushion. Thus, while such inflatable structures may provide advantages by being light weight and more easily transportable in a collapsed condition, in general these do not adequately meet the needs of providing for the positioning and restraining of the person in a manner that the discomfort and possible aggravation leading to further injury are adequately minimized.

The patents which were developed in the above-mentioned search of the patent literature are the following:

U.S. Pat. No. 4,301,791—Franco shows a body transfer unit made up of upper and lower sections, both of which are inflatable members. It is stated at the bottom of column 1 and the top of column 2 of the patent that, "The invention can be employed prior to the treatment of patients suffering from a variety of maladies including fractures, heart attacks, electrical shock, burns, head injuries, amputations, hypothermia . . . ". In one arrangement, this inflatable structure is shown as being attached to a planar "reinforcing member 96" which appears to be a board-like member to which the back side of the back inflatable member is attached. There are various access openings to permit intravenous feeding or the like, or possibly provide access for a heart massage. Such an opening is shown in FIG. 4 at 90, with a closure flap 92 being shown. The unit of this Franco patent has the problems discussed above regarding such inflatable structures, in that the inflatable portions function as structural members and thus would presumably need to be inflated to sufficiently high levels so that these would not be effective as yielding cushions.

U.S. Pat. No. 4,607,655—Wagner et al shows an inflatable and self-supporting survival shelter comprising a floor and sidewalls which assume the configuration of a small tent.

U.S. Pat. No. 4,528,704—Wegener et al shows a patient moving device in which there is a lower inflatable member. A cushion of air is formed under the device so as to raise it from the support surface, something in the nature of a ground effects machine.

U.S. Pat. No. 4,254,518—Buhren et al shows a patient carrying device where there is a base member and sidewalls. The base member is filled with pellets, made of a plastic material. When the patient is supported by the device, it is evacuated and the pellets conform to the contour of the patient.

The following patents show various pressurized garments or devices to position or secure a person's limb. These are the following:

U.S. Pat. No. 4,624,248—Poole et al
U.S. Pat. No. 4,375,809—Neals
U.S. Pat. No. 4,340,042—Smith
U.S. Pat. No. 4,331,133—Arkans
U.S. Pat. No. 4,182,320—Sweeney
U.S. Pat. No. 4,157,713—Clarey U.S. Pat. No. 3,811,139—Shaw shows a stretcher for carrying a person in an immobilized condition. This device has holes mounted in the sidewalls, and rods are placed through the holes to position certain parts of the person's body. In column 4, beginning at line 57 of this patent, it is stated that complete immobilization of the injured person is achieved by placing pillows 34 around the injured person to restrict his movement. It is stated that the pillows are preferably of the inflatable type, and these apply a uniform pressure over a large surface area of the body, these being held in place by a removable top panel 35. Also, pillows are placed near the injured person's head and held in place by a separate transparent faceplate 39 of approximately the same width as the top panel 35.

U.S. Pat. No. 3,286,707—Shafer shows a device which is called a "health aid device", and appears to be a passive exercise device. The person is apparently placed in a frame and held immobilized by an inflatable structure. Then this frame is rotated to give a desired physical effect to the person.

U.S. Pat. No. 1,027,764—Rilleau discloses a device to protect an aviator. There is a double-walled structure which is inflated, and this serves as a protective device for the person in the situation where there is a crash.

U.S. Pat. No. 4,234,982—Bez et al shows a mattress which is loosely filled with a multitude of particles to enable the mattress to adapt in shape to the body contour of the person. Then the mattress is evacuated so as to retain the body contour.

U.S. Pat. No. 4,104,750—Kelter et al shows a baby crib which is formed as an inflatable structure.

U.S. Pat. No. 4,039,039—Gottfried shows a pair of inflatable splinting trousers.

U.S. Pat. No. 4,024,861—Vincet shows an inflatable bag to support victims of spinal injuries. There are retaining members which reach from the bag upwardly around the person's body to retain and position the person.

U.S. Pat. No. 3,740,777—Dee shows a bed support which is inflatable.

U.S. Pat. No. 3,609,778—Zeiner shows what is called a "rigid litter", which is a planar support member on which the person rests. Straps are provided to hold the person on the underlying support member.

U.S. Pat. No. 3,513,486—Miller et al shows a bassinette made up of walls which are inflated to form the structure of the bassinette.

U.S. Pat. No. 3,462,775—Markowitz et al shows a supporting device which is inflated to support a patient in a manner to prevent the formation of bed sores.

U.S. Pat. No. 3,186,405—Bailey et al discloses an inflatable splint.

U S. Pat. No. 3,121,881—Schnell shows a stretcher having a canopy to protect the injured person.

U.S. Pat. No. 4,183,110—Kidd et al shows a casualty transfer system in which the stretcher has two halves to protect the victim. There is a foam plastic lining which is premolded to the dimensions of a "75 percentile man".

U.S. Pat. No. 4,067,075—Leathers et al shows an inflatable stretcher having a plurality of inflatable support members arranged in a herringbone pattern.

U.S. Pat. No. 3,802,004—Whitney shows a waterbed for a person having longterm disabilities. There are a pair of air cells, and by selective inflation of these air cells the depth of the fluid in the waterbed can be raised or lowered without changing the amount of fluid in the bed.

U.S. Pat. No. 3,775,782—Rice et al shows an inflatable aquatic rescue board. Prior to inflation, the rescue board is quite flexible, permitting it to be rolled into a compact bundle for storage. Upon activation of a self-contained compressed gas supply, the rescue board becomes stiff and buoyant to form an aquatic stretcher. The person rests on the board, and straps keep the person in place.

U.S. Pat. No. 3,477,071—Emerson shows what is called a "device for automatically shifting the body of a patient". The patient lies on at least two elongated bladders which can be alternately inflated and deflated to shift the patient.

U.S. Pat. No. 3,460,531—Gardner shows an inflatable splint which is wrapped around a body member, laced up, and then inflated to provide support for the body member.

U.S. Pat. No. 3,212,497—Dickenson shows a moldable temporary splint having two inflatable bladder-like halves which enclose the joint of a person.

U.S. Pat. No. 2,770,465—Dandurand shows a rescue sled having a stretcher body 14.

German patent number 2,263,605—Grunecker et al shows what appears to be a transport system for a person where there is a generally planar base member on which the person is positioned, and a pair of cover members which are folded over from side locations to cover the person. A translation of this patent is not presently available.

SUMMARY OF THE INVENTION

The transport unit of the present invention is particularly adapted to contain an injured person, such as a burn victim, in a manner that the person can be transported with relative comfort and safety. This unit comprises a substantially rigid containing structure having at least front, back and side walls defining and substantially surrounding a containing chamber for the person.

There is an inflatable locating and cushioning means positioned within the structure. This has an inflated position where it defines a containing region corresponding to a configuration of the person's body, with the locating and cushioning means having support surface means arranged to engage, and conform to, substantial surface areas of the person's body to provide locating support for the person's body within the structure. The unit is characterized in that the locating and cushioning means is located within the containing structure so that vertical and lateral loads exerted by the person's body are reacted essentially as compressive forces in the locating and cushioning means, with these forces in turn being transmitted to adjacent portions of the containing structure. Thus, the person's body remains contained, positioned and supported within the unit, without imposing unwanted excessive force loads on a person's body.

In the exemplary embodiment shown herein, the cushioning means comprises an upper cushion section positioned to engage top, side and back portions of the person's head, and also to engage top shoulder portions of the person. Also, there is an intermediate section of the locating and cushioning means to engage at least back and side portions of the person's body, and also engaging inside, outside and back portions of the person's arms. Further, there is a lower section which engages at least outside, inside and back surface portions of the person's legs.

In the specific configuration shown herein, the lower section is arranged to position the person's legs in a spaced apart position, and the unit further comprises means defining a compartment positioned between the leg locations of the lower section of the locating and cushioning means. This compartment contains inflation control apparatus for the unit.

In the preferred form, the containing structure comprises a back section adapted to receive the person in a manner to be positioned adjacent to a backside of the person. There is a front section adapted to be positioned adjacent to a front portion of the person. The back and front sections are adapted to be connected together to form a rigid containing structure, and also adapted to be disengaged from one another for ready access to the containing chamber. Also, in the preferred form, the containing structure comprises a face section adapted to be removably positioned adjacent the person's face, and to be fixedly secured in the containing structure and also to be removable therefrom.

In the preferred form, the locating and cushioning means comprises a plurality of separately inflatable cushions. The unit further comprises selectively operable inflating means to inflate at least some of the cushions separately in a manner that degree of inflation and pressure of said cushions can be controlled.

In the method of the present invention, a unit is provided as described above. Then the person is placed in the containing region and the locating and cushioning means is inflated in a manner that the supporting surface means engages, and conforms to, substantial surface areas of the person's body to provide proper locating support. In the preferred form, the separately inflatable cushions are selectively inflated to a desired level so as to control volume occupied by selected cushions and also pressures thereof.

In the preferred form, a selected portion of the locating and cushioning means is maintained at a reduced pressure level in some instances to alleviate pressure on a selected portion of the person. In other instances, a selected portion of the locating and cushioning means is inflated to a relatively greater level to apply relatively higher pressure to a selected portion of the person.

Other features will become apparent from the following detailed description.

DESCRIPTION OF THE PREFERRED EMBODIMENT

The transport unit or system 10 of the present invention comprises a back section 12, a front lid or cover section 14, and a removable face section 16. In describing the components of the present invention, the terms "front" and "back" will be used relative to the locations of the system 10 that are adjacent to the front and back sides of the person being carried in the system. The terms "upper" or "head" will be used to denote proximity to the location of the head of the person being carried in the system, while the terms "lower" or "foot" will denote the opposite end of the system.

Figure 1:
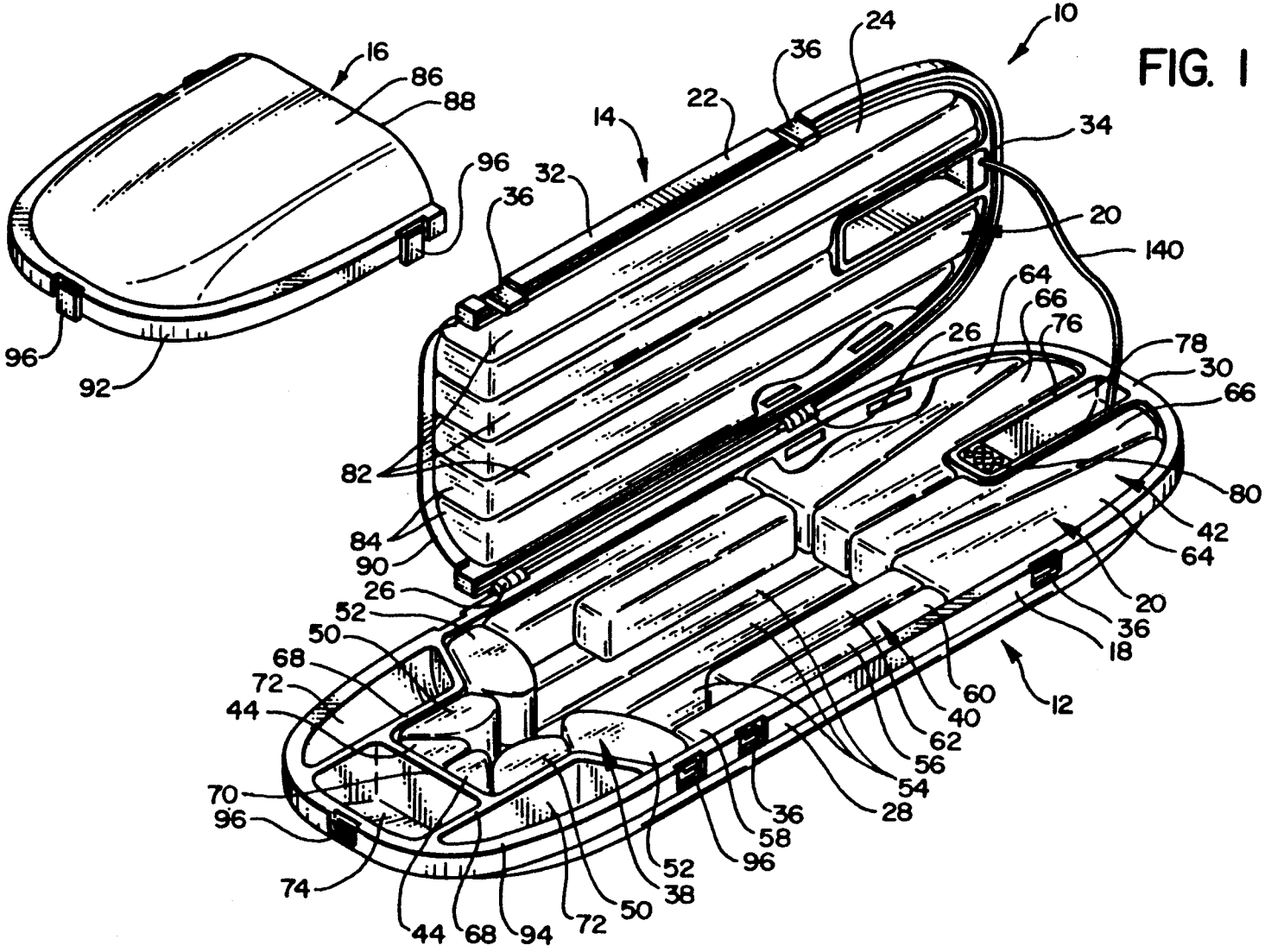
FIG. 1 is an isometric view of the transport system of the present invention, showing the front lid section in its opened position, and showing the face section removed from the back section and the cover section.
Figure 2:
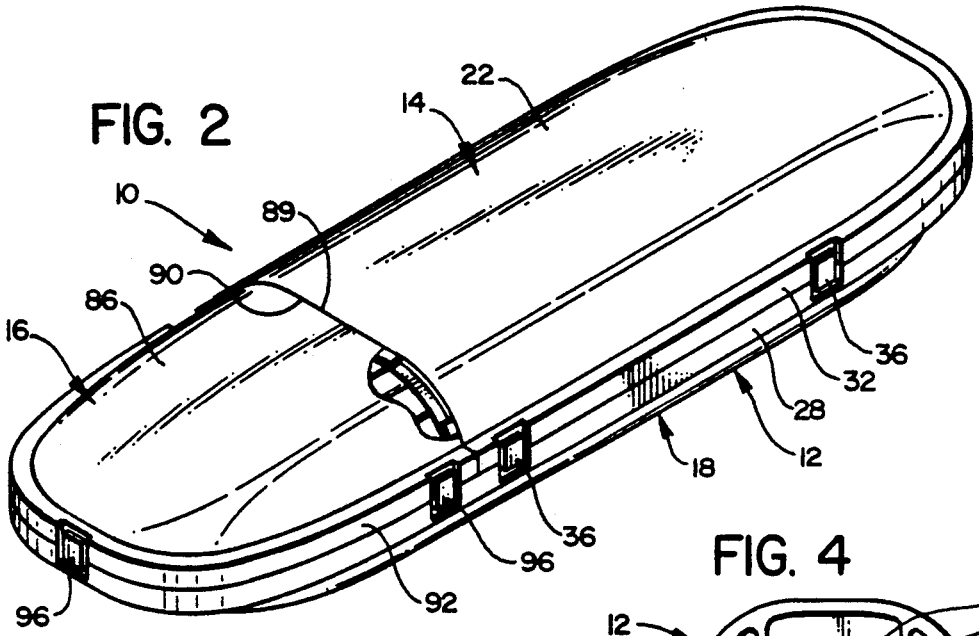
FIG. 2 is an isometric view of the transport system with the three main sections assembled in the closed position.
Figure 3:
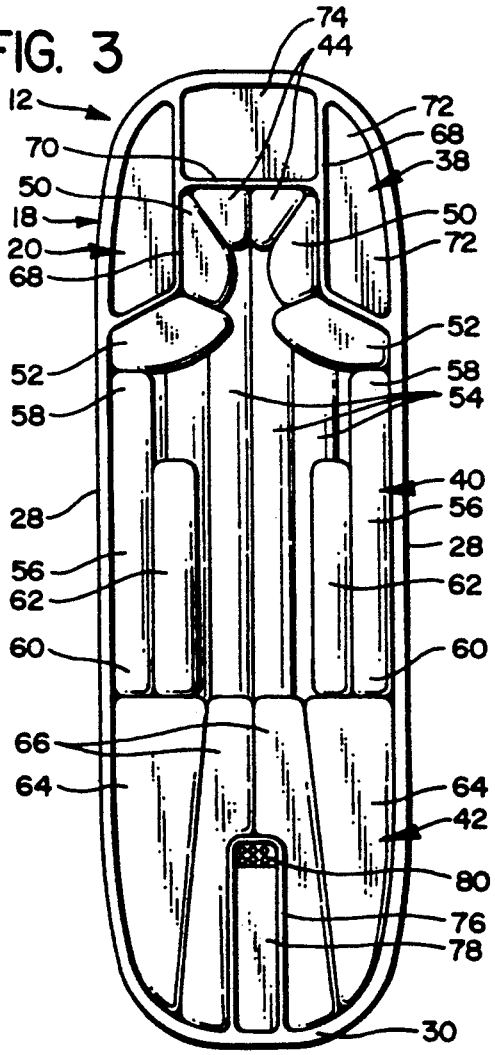
FIG. 3 is a plan view looking toward the interior of the back section.
Figure 4:
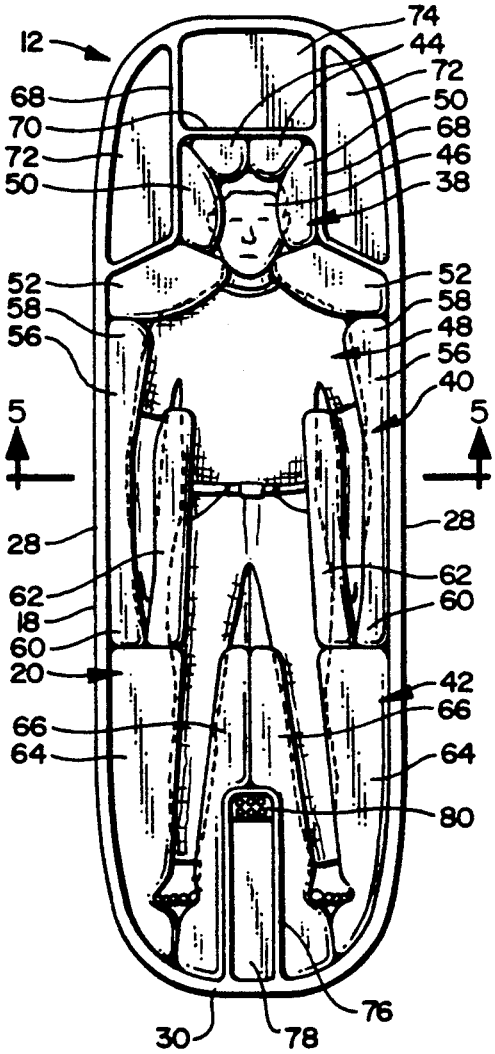
FIG. 4 is a view similar to FIG. 3, but showing a person being positioned in the back section.

The back section 12 comprises a front rigid outside containing structure 18 made of molded plastic or some other suitable structural material, and also comprises a plurality of inflatable locating cushions which collectively comprise the back, side, upper and lower portions of an inflatable locating and cushioning means 20. The front cover section 14 comprises a front rigid containing structure 22 and a front portion 24 of the inflatable locating means 20. The front containing structure 22 is hinge mounted at 26 by one side edge thereof to an adjacent side edge of the back containing structure 18. Thus, the front cover section 14 is adapted to swing to its open position, as shown in FIG. 1, or to be moved to its closed position, as in FIG. 2, where the side edge portions 28 and lower edge portion 30 of the containing structure 18 fit against the side edge portion 32 and lower edge portion 34 of the front section 16. Suitable latch mechanisms 36 are provided to keep the two sections 12 and 14 held securely together, and an appropriate seal and/or cushioning member 37 (see FIG. 5) is provided at the adjacent edge portions. In the closed position, the rigid sections 18 and 22 collectively form a rigid containing structure defining a containing chamber.

The functions of the inflatable locating and cushioning means 20 are critical to the present invention. In the particular embodiment shown herein, the back section 12 has an upper or head inflatable locating portion 38, an intermediate or middle body and arm inflatable locating portion 40, and a lower leg and foot inflatable locating portion 42. In the particular configuration shown herein, the head locating portion 38 comprises a pair of upper head locating cushions 44 positioned to engage the top of the head 46 of the person 48, and two side head cushions 50 positioned to engage side portions of the head 46. Two neck and shoulder locating cushions 52 are also provided.

The intermediate inflatable locating means 40 comprises a plurality of elongate back engaging cushions 54 which extend in a lower to upper direction. There are two elongate lateral cushions 56, the upper ends 58 of which are adapted to engage upper arm and side shoulder portions of the person 48, and the lower side portions 60 of which engage the lower outside arm and hand portions of the person 48. Further, there are a pair of side body cushions 62 which fit between the person's arms and the side of the person's torso and upper leg portions. Also, it should be noted that the upper ends of the back cushions 54 extend upwardly into the upper head portion 38 of the inflatable locating means so as to provide back support for the person's head 46.

The lower portion 42 of the inflatable locating means 20 comprises two side cushions 64 to engage outside surfaces of the person's legs, and also two lower center cushions 66 which fit inside of the person's legs. Also, the back cushions 54 are extended downwardly into the lower inflatable locating portion 42 to provide support for the backside of the person's legs.

The upper portion of the back rigid containing structure 18 has a pair of inner wall sections 68 rigidly attached thereto, with the lower parts of these wall sections 68 being positioned on opposite sides of the side head cushions 50. These wall sections 68 are interconnected by a laterally extending wall section 70 which is positioned just above the top head cushions 44. These wall sections 68 and 70 provide a cavity of an appropriate dimension to accommodate the cushions 44 and 50, and also serve to define two side chambers 72 and an upper chamber 74 which could be used for auxiliary equipment or for temporary storage.

In like manner, there is a U-shaped wall section 76 at the lower end of the back containing structure 18, positioned between the lower ends of the cushions 66. This U-shaped wall section 76 defines a cavity 78 to contain inflation and control apparatus for the system 10. For example, such control equipment, indicated somewhat schematically at 80, controls the inflation and pressure in the various locating cushions.

The front portion 24 of the inflatable locating and cushioning means 20 comprises a plurality of elongate cushions 82 which extend from the lower end portion of the front cover section 14 to an upper end portion 84 thereof. These locating cushions 82 are arranged so that these engage the front surface portion for the person's body. The upperend portion 84 reaches to a location just below the location of the person's head 46.

The removable face section 16 comprises a relatively rigid containing structure 86 having a lower edge 88 which fits against a matching upper edge portion 90 of the rigid structure 22 of the front cover section 14. In addition, the structure 86 comprises a peripheral edge portion 92 which engages an upper and side edge portion 94 which engages an upper and side edge portion 94 of the back rigid containing structure 18. Releasable latching elements 96 are provided on the edge portion of the back containing structure 18 and the face containing structure 86 to permit these two containing structures to be securely latched one to the other.

Figure 5:
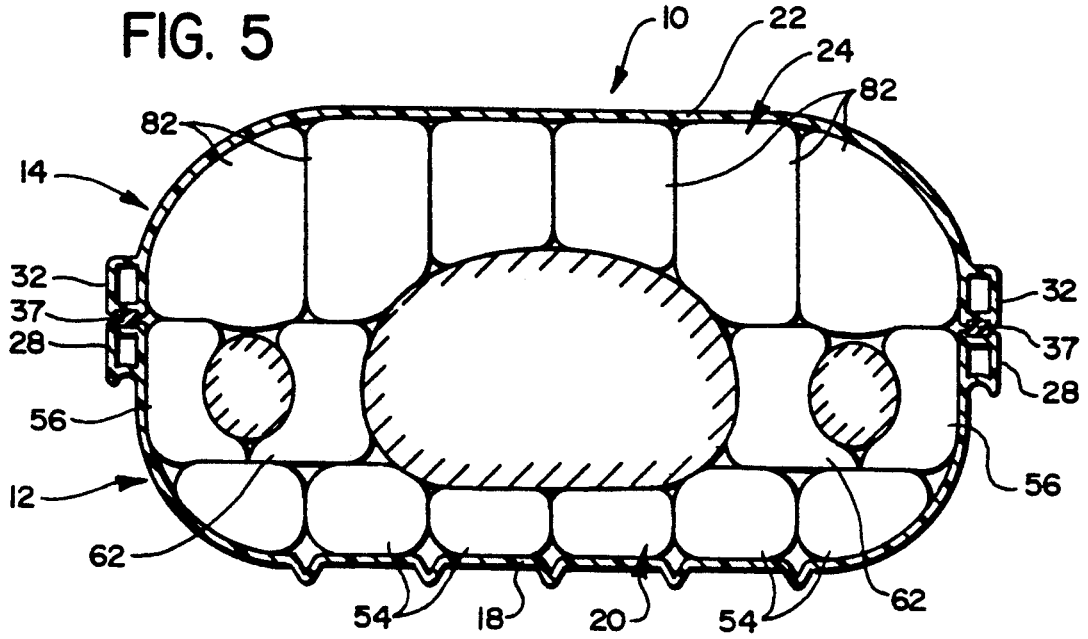
FIG. 5 is a sectional view taken along line 5—5 of FIG. 4.
Figure 6:
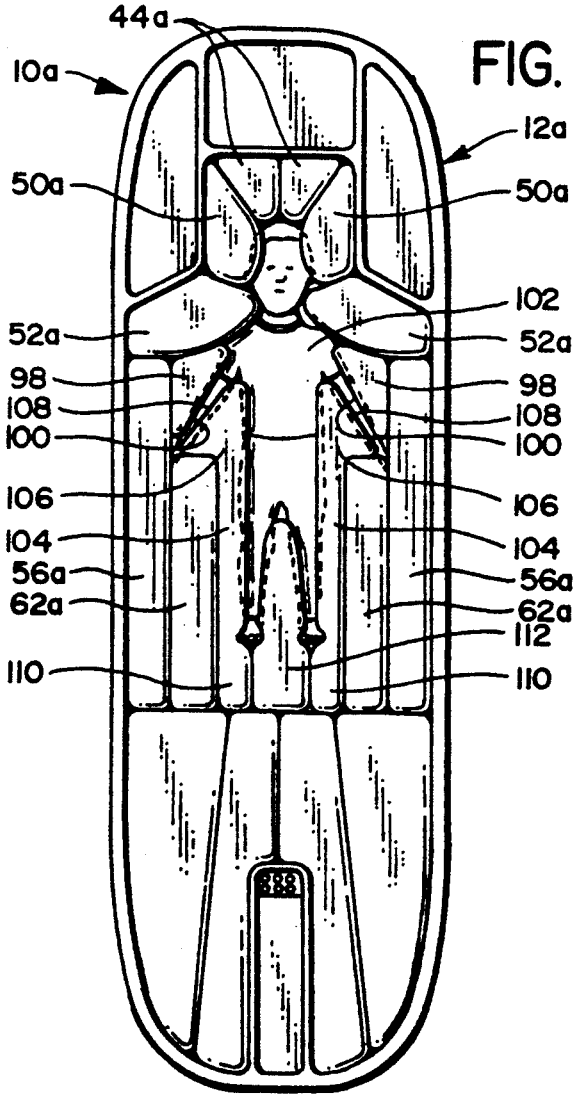
FIG. 6 is a view similar to FIG. 4, but showing the back section having additional inflatable locating cushions being arranged to accommodate a small child.

A second embodiment of the present invention is shown in FIG. 6. This embodiment is substantially the same as the first embodiment shown in FIGS. 1 through 5, and components which are similar to the first embodiment will be given like numerical designation, with an "a" suffix distinguishing those of this second embodiment.

The structure of the second embodiment of FIG. 6 is substantially the same as the first embodiment, so the main components of this second embodiment which are substantially the same as in the first embodiment will not be described herein. Rather, the numerical designation in FIG. 6 will simply indicate those components, and reference can be made to the description of the first embodiment to ascertain their structure and function. This second embodiment is arranged to contain and transport a smaller person, such as a child.

In this second embodiment, there are provided two upper side cushions 98 which fit inside the upper ends of the aforementioned side cushions 56 and have laterally inside surface 100 which slope downwardly and laterally outwardly, with these surfaces 100 engaging the outside arm portions of the child 102. Further, there are also provided a pair of lower side cushions 104 which have upper portions 106 with slanting outwardly facing surfaces 108 matching the surfaces 100 of the cushions 96. The arms of the child are received between these cushion surfaces 100 and 108.

Also, each cushion 104 has a lower portion 110 which extends downwardly along the outside of the child's body and adjacent leg. Then there is a lower central cushion 112 which extends from a location below the child's feet and extends upwardly between the child's legs.

Figure 7:
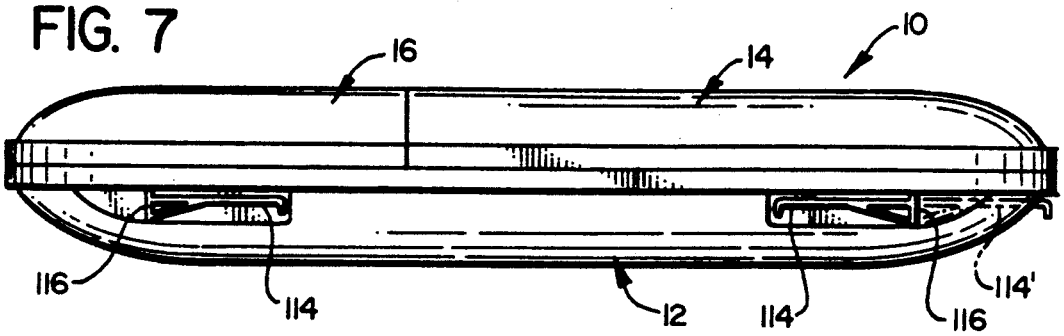
FIG. 7 is a side elevational view of the system of the present invention where the outer containing structure is provided with selectively positionable carrying handles.
Figure 8:
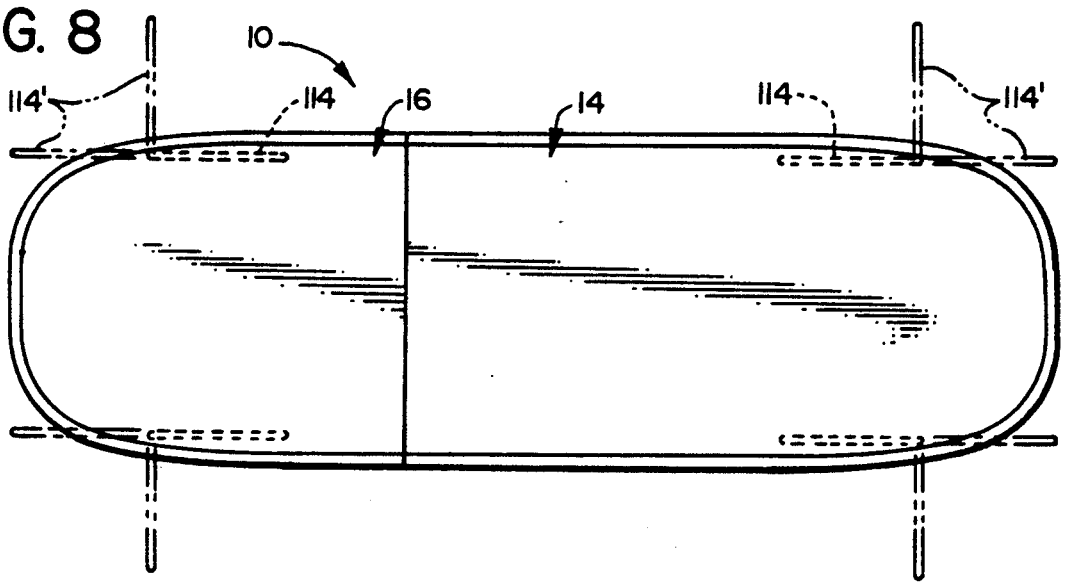
FIG. 8 is a top plan view of the system as shown in FIG. 7, with the carrying handles being positioned in different selected locations.

In FIGS. 7 and 8, the lower rigid containing structure 18 is provided with handle members 114 which are provided at upper and lower side locations to permit the transport unit or system 10 to be carried by four people. Each handle 114 is pivotally mounted about a front to rear vertical axis 116. (This axis 116 would be, of course, vertically oriented if the transport unit 10 is positioned with the back section 12 extending horizontally.) The handles 114 can be swung laterally outwardly to the position shown at 114', or moved to a forward to rear extending location 114', as shown in FIG. 8.

Figure 9:
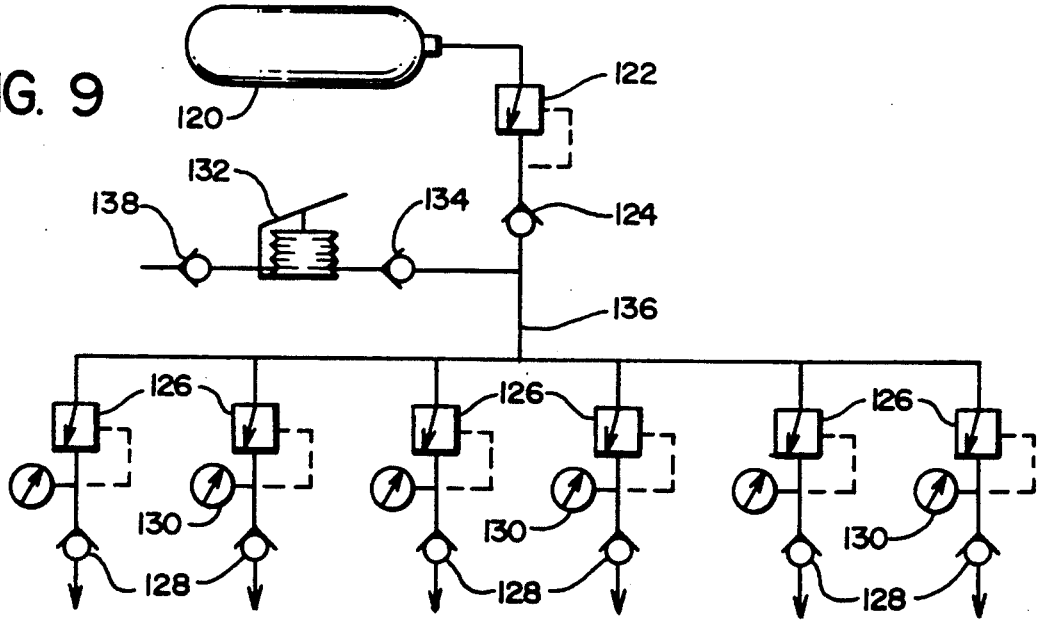
FIG. 9 is a schematic view of the inflating system of the present invention.

The inflating system of the present invention is shown somewhat schematically in FIG. 9. There is a source of pressurized air 120 (which can simply be a tank of compressed air, and the outlet of this tank 120 is directed through a selectively operable pressure regulating valve 122 and through a checkvalve 124 to a plurality of selectively operable secondary valves 126. Each of these valves 126 leads through a respective check valve 128 to one or more of the inflatable locating cushions in the unit or system. Each of these valves 128 is also provided with a suitable pressure gauge 130 so that the pressure within any cushion or cushions can be readily ascertained.

In addition, there is provided a manual pump 132 (or a pump which would be otherwise operable by a person's foot or even a small motor), and this leads through a check valve 134 into the inflating line 136 that leads to the several valves 126. Another check valve 138 is provided upstream of the pump 132. Another pressure gauge 139 is provided to measure pressure in the line 136.

To describe the operation of the present invention, let it be assumed that a person has been involved in an accident and has been burned or otherwise injured, and also that the person must be transported over somewhat difficult terrain to a treatment location, such as to an emergency room of a hospital.

The rescuers would carry the transport unit 10 to the location of the victim, and the back locating cushions 54 would be inflated a suitable amount, this depending to some extent upon the size and condition of the injured person. The person is then placed within the back section 12 so that the person is resting upon the back cushions 54. The arms of the person are positioned between the side cushions 56 and 62, while the legs of the person are located between the lower cushions 64 and 66. The person's head is positioned beneath the upper cushions 44 and between the head side cushions 50.

After this, the operating valve 122 is opened to provide pressure from the tank 120 to the various valves 126. Then, the appropriate secondary valves 126 are opened selectively to permit the appropriate amount of air to flow into the head cushions 44 and 50, the shoulder cushions 52, the intermediate cushions 56 and 62, and also the leg cushions 64 and 66. The amount of air and the pressure to which the cushions are inflated will depend upon various factors, such as the weight and size of the person. In addition, there may be special circumstances which would make it desirable to pressurize some of the cushions to a higher or lower level. For example, if a person has an injured leg, it may be desirable to pressurize one set of the leg cushions 64 and 66 to a somewhat higher level to immobilize the leg. In other circumstances the pressure can be reduced in certain areas where the person might be sensitive to such pressure.

Then the set of cushions 82 in the front section 14 are pressurized to the appropriate level, and the cover section 14 is then moved to its closed position to enclose the person. Depending upon the circumstances, the removable face section 16 may or may not be placed over the person's head. In the even that the face section 16 is secured in place so as to make a totally enclosed structure, then provisions would be made to supply air to the person, for example, by a breathing tube. Also, it is to be understood that other access openings could be provided for intravenous feeding or other purposes. The inflating tank 120 could actually be mounted in the transport unit, or possibly be connected up to the unit 10 to provide the needed pressurized air, after which it would be removed. A connecting cord or hose 140 can be provided so that pressurized air directed into the control unit 80 could in turn inflate the front cushions 82.

With the front lid or cover section 14 closed and latched by means of the latches 36, the transport unit 10 is ready to move the person to an appropriate location. The carrying handles 114 can be used for this purpose, or possibly some other transport means could be used (e.g., movement by helicopter or some other vehicle).

As illustrated in FIG. 5, the various locating cushions are arranged so that these engage substantial surface areas of the person's torso, arms, legs, and head. With this arrangement, it can readily be seem that the various locating cushions can be inflated to a moderate level and still provide adequate resisting force to support the person's weight, and also to engage the person's body in a manner to restrain movement due to possible jostling the transport unit 10. For example, if one or more of the locating cushions are inflated only to one pound per square inch above atmospheric pressure, then one square foot of contact surface of the cushion or cushions (i.e., 144 inches of contact surface) would exert a force of 144 pounds against the adjacent surface portions of the person's body. Thus, for the back cushions 54 to provide a support function with adequate comfort, these would have to be inflated only to a relatively low level. Likewise, the cushions positioned at side portions of the person's torso, limbs and head would need to be inflated only to a level to provide adequate lateral restraint.

In terms of function, it can be seen that the rigid containing structure 18 and 22 (and also the structure 86 if it is used) collectively, when firmly secured together, define an overall rigid, load bearing containing structure where the front, back, and side walls define a containing chamber. Then the inflatable cushioning and locating means 20 in the inflated position have the contact surface areas defining a containing region corresponding to the configuration of the person's body. Any force loads resulting from the person's weight or possibly shifting of the person's body laterally or upwardly due to jostling or movement of the transfer unit 10, will be reacted substantially into the locating cushion through compression loading into the pressurizing medium (generally air) and thence into the rigid containing structure 18–22.

The various cushions 44, 50 through 66 and 82 can be mounted in the structures 18 and 22 so that these are attached at the proper locations. These attachments can be more permanent, or a removable attachment device can be used (e.g., a Velcro-like attachment) so that the cushions can be replaced with different size or shaped cushions, or possibly shifted.

It is to be recognized that various modifications can be made to the present invention without departing from the basic teachings thereof.

What is claimed is:

1. A transport unit particularly adapted to contain an injured person in a manner that the person can be transported with relative comfort and safety, said unit comprising:

a. a substantially rigid containing structure having at least front, back and side walls defining a containing chamber for the person and substantially surrounding the containing chamber;

b. an inflatable locating and cushioning means positioned within said structure and having a first preliminary receiving configuration where the locating and cushioning means defines a containing region which corresponds to a configuration of the person's body, and into which said person is able to be placed, said locating and cushioning means also having a second inflated engaging and locating configuration where the locating and cushioning means is more inflated to engage the person, with the locating and cushioning means having supporting surface means arranged to engage, and to conform to, substantial surface areas of the person's body to provide in the second configuration locating support for the person's body within the structure, said locating and cushioning means comprising a plurality of separately inflatable cushion portions;

c. said unit being characterized in that the locating and cushioning means is located within the containing structure so that vertical and lateral force loads exerted by the person'body are reacted essentially as compressive forces int he locating and cushioning means, with these forces in turn being transmitted to adjacent portions of the containing structure, d. selectively operable inflating means operatively connected to said locating and cushioning means in said containing structure and operable to cause selected inflation of at least some of said cushion portions separately so that said locating and cushioning means can be moved from the first configuration to the second inflated engaging configuration while the person is in the containing region, and degree of inflation and pressure of said cushion portions can be controlled whereby the person's body remains contained, positioned and supported within said unit, without imposing excessive localized force loads on the person's body.

2. The unit as recited in claim 1, wherein said locating and cushioning means comprises an upper cushion section positioned to engage top, side and back portions of a person's head, and also to engage top shoulder portions of the person.

3. The unit as recited in claim 1, wherein said locating and cushioning means comprises an intermediate section, engaging at least back and side portions of the person's body, and also engaging inside, outside and back portions of the person's arms.

4. The unit as recited in claim 1, wherein said locating and cushioning means comprising a lower section which engages at least outside, inside and back surface portions of the person's legs.

5. The unit as recited in claim 4, wherein said lower section is arranged to position the person's legs in a spaced apart position, said unit further comprising means defining a compartment positioned between leg locations of the lower section of the locating and cushioning means.

6. The unit as recited in claim 1, wherein said unit comprises inflation control apparatus for selective inflation of said locating and cushioning means.

7. The unit as recited in claim 1, wherein:

a) said locating and cushioning means comprises an upper cushion section positioned to engage top, side and back portions of a person's head, and also to engage top shoulder portions of the person;

b) said locating and cushioning means comprises an intermediate section, engaging at least back and side portions of the person's body, and also engaging inside, outside and back portions of the person's arms;

c) said locating and cushioning means comprises a lower section which engages at least outside, inside and back surface portions of the person's legs.

8. The unit as recited in claim 7, wherein:

a) said lower section is arranged to position the person's legs in a spaced apart position, said unit further comprising means defining a compartment positioned between leg locations of the lower section of the locating and cushioning means;

b) said compartment defining means contains inflation control apparatus for said unit.

9. The unit as recited in claim 1, wherein said substantially rigid containing structure comprises a back section adapted to receive the person in a manner to be positioned adjacent to a backside of the person, and a front section adapted to be positioned adjacent a front portion of the person, said back and front containing structure sections being adapted to be connected together to form a rigid containing structure, and also adapted to be disengaged from one another for ready access to said containing chamber.

10. The unit as recited in claim 9, wherein said rigid containing structure further comprises a face section adapted to be positioned adjacent the person's face, said face section being adapted to be fixedly secured in said containing structure and to be removable therefrom.

11. A method of containing and transporting an injured person in a manner that the person can be transported with relative comfort and safety, said method comprising:

a. providing a substantially rigid containing structure having at least front, back and side walls defining a containing chamber for a person and substantially surrounding the containing chamber;

b. positioning an inflatable locating and cushioning means positioned within said structure in a manner that the locating and cushioning means defines a containing region corresponding to a configuration of the person'body, said locating and cushioning means comprising a plurality of separately inflatable cushion portions;

c. while the inflatable locating and cushioning means is positioned within said structure, placing the person in the containing region and inflating the locating and cushioning means in a manner that supporting surface means of the locating and cushioning means by being selectively inflated comes into containing engagement, and conforms to, substantial surface areas of the person's body to provide locating support for the person's body within the structure;

d. said method being characterized in that the locating and cushioning means is located within the containing structure so that vertical and lateral force loads exerted by the person's body are reached essentially as compressive forces in the locating and cushioning means, with these forces in turn being transmitted to adjacent portions of the containing structure, whereby the person's body remains contained, positioned and support within said unit, without imposing excessive localized force loads on the person's body.

12. The method as recited in claim 11, wherein said method further comprises selectively inflating said cushion portions to a desired level to control volume occupied by selected cushion portions and also pressures thereof.

13. The method as recited in claim 12, wherein a selected portion of said locating and cushioning means is maintained at a reduced pressure level to alleviate pressure on a selected portion of the person.

14. The method as recited in claim 12, further comprising inflating a selected portion of the locating and cushioning means to a relatively greater level to apply relatively higher pressure to a selected portion of the person.

15. A transport unit particularly adapted to contain an injured person in a manner that the person can be transported with relative comfort and safety, said unit comprising:

a. a substantially rigid containing structure having at least back and side walls defining a containing chamber for the person and substantially surrounding the containing chamber;

b. an inflatable containing and cushioning means positioned within said structure and having a first preliminary receiving configuration where the locating and cushioning means defines a containing region which corresponds to a configuration of the person's body, and into which said person is able to be placed, said locating and cushioning means also having a second inflated engaging and locating configuration where the locating and cushioning means is more inflated to engage the person, with the locating and cushioning means having supporting surface means arranged to engage, and conform to, substantial surface areas of the person's body to provide in the second configuration locating support for the person'body within the structure, said locating and cushioning means comprising a plurality of separately inflatable cushion portions;

c. said unit being characterized in that the locating and cushioning means is located within the containing structure so that vertical and lateral force loads exerted by the person's body are reacted essentially as compressive forces in the locating and cushioning means, with these forces in turn being transmitted to adjacent portions of the containing structure, d. selectively operable inflating means operatively connected to said locating and cushioning means in said containing structure and operable to cause selected inflation of at least some of said cushion portions separately so that said locating and cushioning means can be moved from the first configuration to the second inflated engaging configuration while the person is in the containing region, and degree of inflation and pressure of said cushion portions can be controlled, whereby the person's body remains contained, positioned and supported within said unit, without imposing excessive localized force loads on the person's body.

16. The unit as recited in claim 15, wherein said cushioning means comprises an upper cushion section positioned to engage top, side and back portions of a person's head, and also to engage top shoulder portions of the person.

17. The unit as recited in claim 15, wherein said locating and cushioning means comprises an intermediate section, engaging at least back and side portions of the person's body, and also engaging inside, outside and back portions of the person's arms.

18. The unit as claimed in claim 15, wherein said locating and cushioning means comprising a lower section which engages at least outside, inside and back surface portions of the person's legs.

19. The unit as recited in claim 18, wherein said lower section is arranged to position the person's legs in a spaced apart position, said unit further comprising means defining a compartment positioned between leg locations of the lower section of the locating and cushioning means.

20. The unit as recited in claim 15, wherein said unit comprises inflation control apparatus for selective inflation of said locating and cushioning means.

21. The unit as recited in claim 15, wherein:

a. said cushioning means comprises an upper cushion section positioned to engage top, side and back portions of a person's head, and also to engage top shoulder portions of the person;

b. said locating and cushioning means comprises an intermediate section, engaging at least back and side portions of the person's body, and also engaging inside, outside and back portions of the person's arms;

c. said locating and cushioning means comprises a lower section which engages at least outside, inside and back surface portions of the person's legs.

22. The unit as recited in claim 21, wherein:

a. said lower section is arranged to position the person's legs in a spaced apart position, said unit further comprising means defining a compartment positioned between leg locations of the lower section of the locating and cushioning means;

b. said compartment defining means contains inflation control apparatus of said unit.

23. A method of containing and transporting an injured person in a manner that the person can be transported with relative comfort and safety, said method comprising:

a. providing a substantially rigid containing structure having at least back and side walls defining a containing chamber for a person and substantially surrounding the containing chamber;

b. positioning an inflatable locating and cushioning means positioned within said structure in a manner that the locating and cushioning means defines a containing region corresponding to a configuration of the person's body, said locating and cushioning means comprising a plurality of separately inflatable cushion portions;

c. while the inflatable locating and cushioning means is positioned within said structure, placing the person in the containing region and inflating the locating and cushioning means in a manner that supporting surface means of the locating and cushioning means by being selectively inflated comes into containing engagement, and conforms to, substantial surface areas of the person's body to provide locating support for the person's body within the structure;

d. said method being characterized in that the locating and cushioning means is located within the containing structure so that vertical and lateral forces exerted by the person's body are reached essentially as compressive forces in the locating and cushioning means, with these forces in turn being transmitted to adjacent portions of the containing structure, whereby the person's body remains contained, positioned and supported within said unit, without imposing excessive localized force loads on the person's body.

24. The method as recited in claim 23, wherein said method further comprises selectively inflating said cushion portions to a desired level to control volume occupied by selected cushion portions and also pressures thereof.

25. The method as recited in claim 24, wherein a selected portion of said locating and cushioning means is maintained at a reduced pressure level to alleviate pressure on a selected portion of the person.

26. The method as recited in claim 24, further comprising inflating a selected portion of the locating and cushioning means to a relatively greater level to apply relatively higher pressure to a selected portion of the portion.

* * * * *